United States Patent [19]

Williams

[11] 4,291,463

[45] Sep. 29, 1981

[54] WATER-SOLUBLE SHAVING AID FOR RAZOR BLADES

[75] Inventor: Peter S. Williams, Stratford, Conn.

[73] Assignee: Warner-Lambert Company, Morris Plains, N.J.

[21] Appl. No.: 108,743

[22] Filed: Dec. 31, 1979

[51] Int. Cl.[3] ..... B26B 21/00

[52] U.S. Cl. ..... 30/346.53; 428/192; 428/422; 428/461

[58] Field of Search ..... 30/346.53; 427/284; 428/192, 422, 461

[56] References Cited

U.S. PATENT DOCUMENTS

| | | | |
|---|---|---|---|
| 3,224,094 | 12/1965 | Esemplare | 30/346.53 |
| 3,224,900 | 12/1965 | Creamer | 30/346.53 X |
| 4,012,551 | 3/1977 | Bogaty | 30/346.53 |

FOREIGN PATENT DOCUMENTS

| | | | |
|---|---|---|---|
| 1050244 | 4/1963 | United Kingdom | 30/346.53 |

*Primary Examiner*—Jimmy C. Peters

*Attorney, Agent, or Firm*—R. S. Strickler

[57] ABSTRACT

A solid water-soluble lubricating shaving aid is provided as an adherent coating on a razor blade. The solid coating contains polyethylene oxide as a lubricant.

7 Claims, 1 Drawing Figure

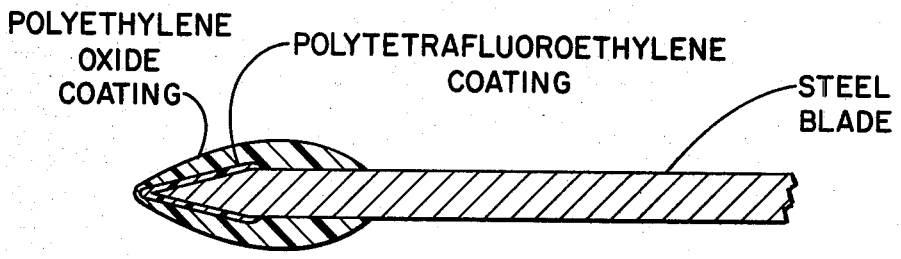
POLYETHYLENE
OXIDE
COATING
POLYTETRAFLUOROETHYLENE
COATING
STEEL
BLADE

WATER-SOLUBLE SHAVING AID FOR RAZOR BLADES

BACKGROUND OF THE INVENTION

Normal shaving practice involves preparation of the beard by application of a shaving cream. One purpose of this preparation is to soften the beard by retaining water on the face. A second purpose of the shaving cream is to serve as a lubricating agent so that the shaving element will glide smoothly over the face. However, during shaving it is often necessary to repeatedly stroke the same area of the face after the shaving cream is removed by the first stroke, thereby denying successive strokes the aid of the lubrication provided by the shaving cream. Thus, it is often necessary to apply additional quantities of shaving cream.

It is also known in the art that a reduction in the frictional forces encountered between blade and whiskers during shaving can be obtained, at least to some extent, by applying to the cutting edge coatings of certain polymers such as polytetrafluoroethylene as disclosed in U.S. Pat. No. 3,071,856 to I. W. Fischbein and organosiloxanes disclosed in U.S. Pat. No. 2,937,976 to L. E. Granahan et al. U.S. Pat. No. 2,292,417 to Wetherbee discloses blade coatings containing a wax and a "surface active material". Wetherbee disclosed that components of the wax and the "surface active material" may be "slightly soluble in water".

It is also known that the application of certain water-soluble polymers to the face serves to facilitate shaving.

SUMMARY OF THE INVENTION

It has now been discovered that coatings containing water-soluble polyethylene oxide can be applied directly to a razor blade which, when wetted during shaving, will provide a continuous flow of lubricating shaving aid onto the face. This discovery contrasts with the prior art teachings in that it provides razor blade coatings which are water-soluble to provide shaving lubrication.

BRIEF DESCRIPTION OF THE DRAWING

The sole FIGURE is a cross-sectional view of a steel razor blade coated with polyethylene oxide in accordance with the present invention.

DESCRIPTION OF THE PREFERRED EMBODIMENTS

Commercial grades of polyethylene oxide normally have a molecular weight range of about 100,000 to 4,000,000 and are supplied in the form of white dry powders. This commercial polyethylene oxide may be applied in any conventional manner which does not cause decomposition to form a coating on a razor blade in accordance with the present invention. A preferred technique for forming the adherent coating is to coat the razor blade with the polyethylene oxide in the form of a viscous aqueous solution. Other modes of applying polyethylene oxide as a coating are suggested by the molding techniques disclosed by the Union Carbide Corporation publication dated May 1972 and entitled "Polyox, Water Soluble Resins: Thermoplastic Processing: Calendaring, Extrusion, and Injection Molding", the teachings of which are incorporated herein by reference. Since the polyethylene oxide polymer has poor adhesion to the metal blade surface, a minor amount of an adhesion-promoting agent, such as hydantoinformaldehyde resin, is preferably blended with the polyethylene oxide polymer.

The coating may cover the entire blade or merely the area adjacent the cutting edge. The coating may actually extend around the cutting edge without any adverse effect in view of the water-soluble nature of the coating. Moreover, as depicted in the FIGURE, the blade or blade edge is preferably first coated in a known manner with a friction-reducing material, such as polytetrafluoroethylene, and the water-soluble lubricating coating of the invention is then applied thereover.

The coating of the present invention may contain the polyethylene oxide in admixture with the other surface-active agents, other water-soluble polymers and even with water-insoluble polymers. A preferred coating formulation consists of a 10% by weight solution of a 50—50 (parts by weight) admixture of "Polyox" (Tradename of the Union Carbide Corporation) and "Pluronic" (Trademark of the Wyandotte Chemicals Corporation) in a 50—50 (by volume) mixture of isopropyl alcohol and water. The preferred "Pluronic" materials are solid or paste-like and may be represented by the expression ARB wherein "A" represents the molecular weight (in hundreds) of the poly(oxypropylene) portion of the molecule and is equal to a greater than 25 (i.e., MW2500) and "B" represents the poly(oxyethylene) portion of the molecule and is equal to or greater than 4 (hundred). A "25R8 Pluronic" is preferred and "31 R4 Pluronic" is also suitable. The preferred "Polyox" for such a formulation is Union Carbide Grade WRPA 1354 or WSR 1105, each having a molecular weight of about 900,000. After application of such aqueous formulation to the razor blade, it is dried to form a dry coating approximately 5 mils in thickness.

Preferred formulations include aqueous solutions of polyethylene oxide and at least one other high molecular weight surface active agent. The solute admixture may contain up to 60 weight percent of the additional high molecular weight surface-active agent.

In shaving with a blade having such a coating as described above, the face is first wetted and a portion of the polyethylene oxide (and any additional surface-active agent) is dissolved during shaving and thereby provides a lubricating effect.

Additions, deletions and modifications of the preferred embodiment illustrating the invention may be made by those skilled in the art and are within the scope of the invention as defined by the following claims.

I claim:

1. A razor blade having an adherent solid, water-soluble coating comprising polyethylene oxide.

2. The coated razor blade of claim 1 wherein said coating further comprises an additional high molecular weight surface-active agent.

3. A razor blade in accordance with claim 2 wherein said additional surface-active agent is represented by the expression:

ARB wherein:

A is poly(oxypropylene) of MW$\geqq$2500; and

B is poly(oxyethylene) of MW$\geqq$400.

4. A razor blade in accordance with claim 1, wherein said coating additionally comprises an adhesion-promoter.

5. A razor blade in accordance with claim 4 wherein adhesion-promoter is hydantoinformaldehyde.

6. The coated razor blade of claim 1 wherein said coating of polyethylene oxide overlies a coating of polytetrafluoroethylene.

7. The coated razor blade of claim 6 wherein said coating of polyethylene oxide further comprises an additional high molecular weight surface-active agent and an adhesion-promoter.

* * * * *